US005673758A

United States Patent [19]

Sasaki et al.

[11] Patent Number: 5,673,758

[45] Date of Patent: Oct. 7, 1997

[54] LOW-NOISE IMPACT SCREWDRIVER

[75] Inventors: Yasuo Sasaki; Mitsuo Ogura, both of Hitachinaka, Japan

[73] Assignee: Hitachi Koki Company Limited, Tokyo, Japan

[21] Appl. No.: 457,207

[22] Filed: Jun. 1, 1995

[30] Foreign Application Priority Data

Jun. 9, 1994 [JP] Japan ..... 6-127728

[51] Int. Cl.[6] ..... B25B 19/00

[52] U.S. Cl. ..... 173/178; 173/93.6; 173/97

[58] Field of Search ..... 173/178, 93, 93.5, 173/93.6, 97, 111

[56] References Cited

U.S. PATENT DOCUMENTS

| | | | |
|---|---|---|---|
| 3,331,452 | 7/1967 | Wanner | 173/178 |
| 3,369,615 | 2/1968 | Maffey, Jr. et al. | 173/93.6 |
| 3,450,214 | 6/1969 | Bangerter et al. | 173/178 |
| 3,476,192 | 11/1969 | Noerr, Jr. | 173/178 |
| 4,243,129 | 1/1981 | Schoeps | 173/178 X |
| 5,129,465 | 7/1992 | Rahm | 173/178 |
| 5,139,093 | 8/1992 | Lyon et al. | 173/97 |

FOREIGN PATENT DOCUMENTS

| | | |
|---|---|---|
| 0552990 | 7/1993 | European Pat. Off. . |
| 667436 | 10/1938 | Germany . |

*Primary Examiner*—Joseph J. Hail, III
*Assistant Examiner*—Jay A. Stelacone
*Attorney, Agent, or Firm*—Lowe, Price, LeBlanc & Becker

[57] ABSTRACT

An improved structure of an impact screwdriver is provided which achieves a low-noise screw-driving operation. The impact screwdriver includes a clutch assembly for transmitting torque provided by a motor to a tool bit. The clutch assembly includes a toque-transmitting member, a torque-outputting member, and a clutch coil spring. The clutch coil spring is selectively wound around the torque-transmitting member and the torque-outputting member according to a rotational difference therebetween to establish torque transmission for providing the torque to the tool bit intermittently.

11 Claims, 3 Drawing Sheets

LOW-NOISE IMPACT SCREWDRIVER

BACKGROUND OF THE INVENTION

1. Technical Field of the Invention

The present invention relates generally to a torque-outputting apparatus, and more particularly to an improved structure of an impact screwdriver which is designed to reduce an engagement shock of a clutch assembly to achieve a low-noise screw-driving operation.

2. Background of the Related Art

FIG. 5 shows a conventional impact screwdriver which includes a drive shaft 2, an impactor or hammer 36, steel balls 10 and 11, and a compression coil spring 12. The drive shaft 2 has formed therein a pair of cam grooves 6 and 7. Similarly, the hammer 36 has formed therein a pair of cam grooves 37 and 38. The steel balls 10 and 11, as can be seen from the drawing, engage both the pairs of cam grooves 6, 7, 37, and 38.

When the screwdriver is powered by a motor, it will cause the hammer 36 to move back and forth while rotating along leading paths defined by the cam grooves 6, 7, 37, and 38 to transmit torque to a screw 35. This torque transmission to established in engagement of clutch jaws 40 and 41 of the hammer 36 with clutch jaws 43 and 44 of a torque-outputting member or spindle 42. When a screw-tightening torque becomes large to decrease the rotational speed of the spindle 42 due to a reaction acting thereon, the hammer 36 moves back against a spring force of the compression coil spring 12 along the leading paths of the cam grooves 6, 7, 37, and 38. When the hammer 36 moves back so that the engagement of the clutch jaws 40 and 41 with the clutch jaws 43 and 44 is released, the hammer 36 is urged by the compression coil spring 12 to advance while rotating. Upon rotation of about 180 deg, the clutch jaws 40 and 41 collide with or engage the clutch jaws 43 and 44 again to produce a great screw-tightening torque. In this manner, the conventional impact screwdriver strikes intermittent blows at the spindle 42 to produce a great torque, however, encounters a drawback in that the engagement of the clutch jaws 40 and 41 with the clutch jaws 43 and 44 raises a high level noise.

SUMMARY OF THE INVENTION

It is therefore a principal object of the present invention to avoid the disadvantages of the prior art.

It is another object of the present invention to provide an improved structure of an impact screwdriver which is designed to reduce shock caused by engagement of a clutch assembly to decrease noise in a screw-driving operation.

According to one aspect of the present invention, there is provided a torque outputting apparatus which comprises a torque-outputting member, a drive shaft rotated by a motor, a torque-transmitting member, a clutch spring, and a cam means. The torque-transmitting member transmits torque provided by rotation of the drive shaft to the torque-outputting member for outputting the torque through the torque-outputting member. The clutch spring selectively connects between the torque-outputting member and the torque-transmitting member to establish torque transmission therebetween in first and second relative angular positions of the torque-outputting member and the torque-transmitting member. A first level of torque is transmitted to the torque-outputting member in the first relative angular position, while a second level of torque greater than the first level is transmitted to the torque-outputting member in the second relative angular position. The cam means, responsive to the rotation of the drive shaft, for connecting the torque-outputting member and the torque-transmitting member through the clutch spring in the first relative angular position until the torque of the drive shaft reaches a given level for outputting the first level of torque through the torque-outputting member. The cam means releases the connection between the torque-outputting member and the torque-transmitting member to allow a relative rotation between the torque-outputting member and the torque-transmitting member until the second relative angular position is reached when the torque of the drive shaft exceeds the given level for outputting the second level of torque through the torque-outputting member.

In the preferred mode of the invention, the clutch spring is a coil spring which is selectively wound over the torque-outputting member and the torque-transmitting member to establish the connection therebetween.

The torque-outputting member and the torque-transmitting member are formed to have respective cylindrical grooves in which the clutch spring is disposed.

The torque-outputting member has a securing means for securing one end of the coil spring thereto, while the torque-transmitting member has an engaging means for having the other end of the coil spring engage therewith in the first and second relative angular positions of the torque-outputting means and the torque-transmitting means.

The torque-transmitting member may alternatively have a securing means for securing one end of the coil spring thereto, while the torque-outputting member may have an engaging means for having the other end of the coil spring engage therewith in the first and second relative angular positions of the torque-outputting means and the torque-transmitting means.

The torque-outputting means and the torque-transmitting means are arranged in alignment with each other at a given interval therebetween.

A jam prevention means is provided for preventing the clutch spring from entering the given interval between the torque-outputting means and the torque-transmitting means.

The jam prevention means comprises tapered surfaces of clutch jaws formed on the torque-outputting member and the torque-transmitting member, respectively.

The cam means includes a first cam groove, a second cam groove, and a cam follower. The first cam groove is formed on the drive shaft. The second cam groove is formed in the torque-transmitting member. The cam follower is retained between the first and second cam grooves to serve to move the torque-transmitting member for releasing the connection between the torque-outputting member and the torque-transmitting member when the torque of the drive shaft exceeds the given level.

The cam follower includes a ball member. The first cam groove is of V-shape. The ball member moves the torque-transmitting member away from the torque-outputting member along a given path defined by the first and second cam grooves according to the rotation of the drive shaft when the torque of the drive shaft exceeds the given level.

According to another aspect of the invention, there is provided a torque-outputting apparatus which comprises a torque-outputting member, a drive shaft rotated by a motor, a torque-transmitting member transmitting torque provided by rotation of the drive shaft to the torque-outputting member for outputting the torque through the torque-outputting member, a clutch spring, and a cam means, responsive to the rotation of the drive shaft, for selectively winding the clutch spring around the torque-outputting member and the torque-transmitting member to establish torque transmission therebetween according to a rotational difference between the torque-transmitting member and the torque-outputting member.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings:.

DESCRIPTION OF THE PREFERRED EMBODIMENT

Figure 1:
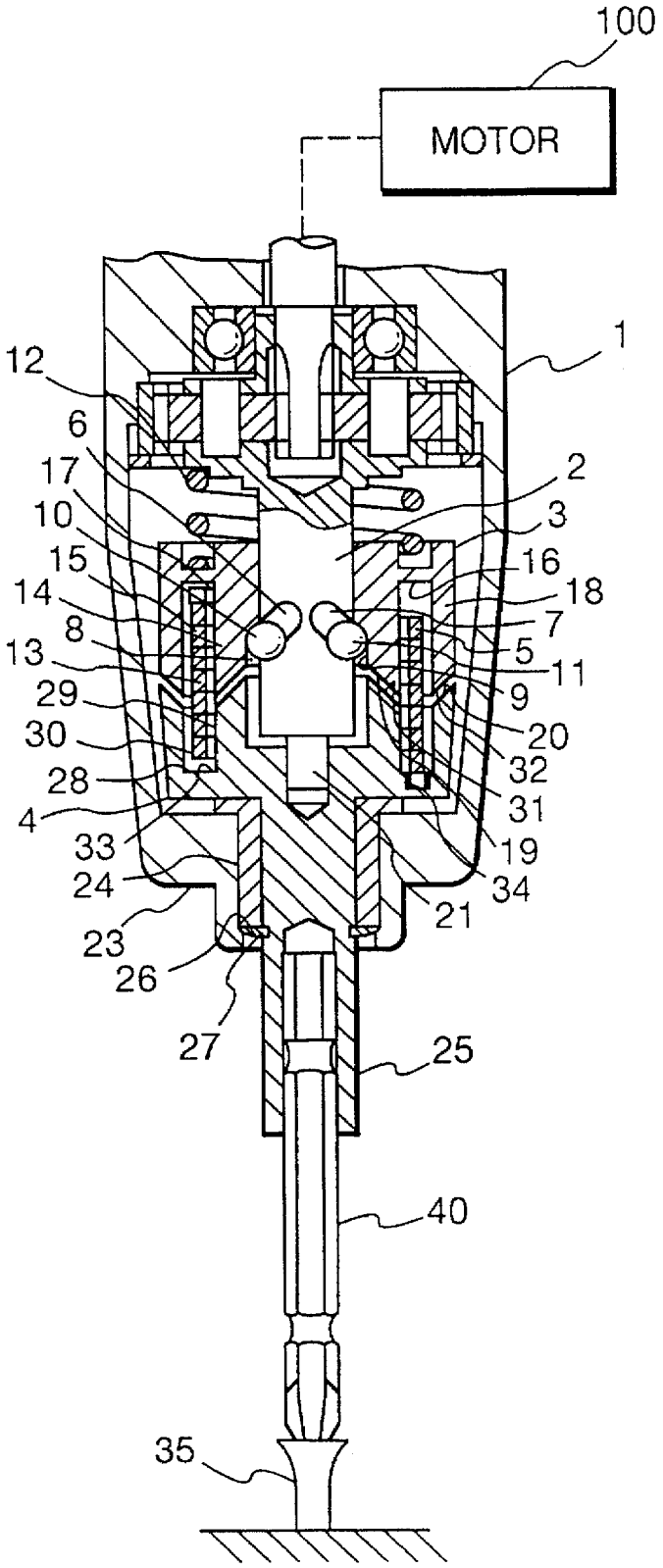
FIG. 1 is a vertical cross sectional view which shows an impact screwdriver according to the present invention.

Referring now to the drawings, particularly to FIG. 1, there is shown a motor-driven impact screwdriver 1 according to the present invention.

The impact screwdriver 1 includes generally a drive shaft 2, steel balls 10 and 11, a compression coil spring 12, and a clutch assembly. The clutch assembly includes a cylindrical hammer 3, an anvil 4, and a clutch spring 5.

Figure 2:
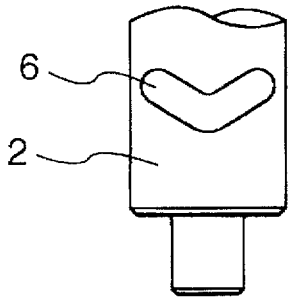
FIG. 2 is a perspective view which shows a cam groove formed in a drive shaft.

The drive shaft 2 has formed in its outer surface a pair of cam grooves 6 and 7 each being, as shown in FIG. 2 (only one is shown for the brevity of illustration) of V-shape curved downward as viewed in the drawing. Similarly, the hammer 3 has formed in its outer surface a pair of cam grooves 8 and 9. The steel balls 10 and 11 are respectfully retained within the cooperating paris of cam grooves, i.e., by groove 6 cooperating with 8 and 7 with 9. The compression coil spring 12 is disposed around the drive shaft 2 to urge the hammer 3 toward the anvil 4.

Figure 3:
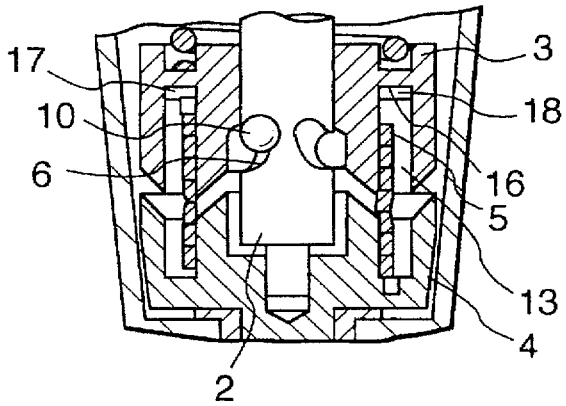
FIG. 3 is a partial cross sectional view which shows an engagement condition of a hammer and an anvil through a clutch spring.

The hammer 3 has also formed therein a cylindrical groove 13 coaxially with the drive shaft 2. The cylindrical groove 13 is defined by an inner cylindrical surface 14 and an outer cylindrical surface 15. Within the groove 13, the clutch spring 5 is disposed. Protrustons 17 and 18, as clearly seen in FIG. 3, are formed on portions of a bottom surface 16 of the cylindrical groove 13 diametrically opposite each other.

The hammer 3 further has a clutch jaw defined by tapered surfaces 19 and 20, and is supported by the coil spring 12 at a given interval away from an upper surface of the anvil 2.

The anvil 4 includes a bearing bore 21, a tool bit holding spindle 25, and a cylindrical groove 28. The bearing bore 21 rotatably supports an end portion of the drive shaft 2. The spindle 25 extends from the bottom of the anvil 4 and is retained in a bearing 24 disposed within a housing 23 so as to rotate coaxially with the drive shaft 2. The spindle 25 has formed in its outer surface a groove 27 within which a stop ring 26 is disposed which engages the bottom of the bearing 24 to restrict axial movement of the spindle 25 toward the hammer 3. The cylindrical groove 28 in anvil 4 is formed in alignment with the groove 13 of the hammer 3 for receiving therein the clutch spring 5. The anvil 4, similar to the hammer 3, has a clutch jaw defined by tapered surfaces 31 and 32 which can engage the clutch jaw of the hammer 3. In the bottom 33 of the cylindrical groove 28, a hole 34 is formed to hold one end of the clutch spring 5 to the anvil 4.

The clutch spring 5 is formed with a spring element of square shape in cross section which has the width much greater in the axial direction than the interval between the clutch jaws of the hammer 3 and the anvil 4, and is wound up in a coil. Both ends of the clutch spring 5 are bent parallel to the center line of the spring. The clutch spring 5 is disposed within the cylindrical grooves 13 and 28 with given play between the inner cylindrical surfaces 14 and 29 and the outer cylindrical surfaces 15 and 30.

In a screw-tightening operation, an electric motor 100 is activated to rotate the drive shaft for transmitting torque to the hammer 3 through the steel balls 10 and 11. The hammer 3 then rotates so that the end of the clutch spring 5 engages with the protrusion of the hammer 3 to thereby provide a torque to the anvil 4, which torque is, in turn, transmitted to a tool bit 40 through the spindle 25. Due to a load torque or reaction from the screw 35, a rotational difference is produced between the hammer 3 and the anvil 4 so that the clutch spring 5 is contracted in a diameter-decreasing direction and then wound around the inner cylindrical surfaces 14 and 29 of the hammer 3 and the anvil 4 firmly to rotate together therewith.

Increasing the torque transmitted to the hammer 3 causes only the drive shaft 2 to rotate since the hammer 3 is secured to the anvil 4 through the clutch spring 5 so that the steel balls 10 and 11 move in the V-shaped cam grooves 6 and 7 to draw the hammer 3 away from the anvil 4 against the spring force of the compression coil spring 12. This will cause the end of the clutch spring 5 in the hammer 3 to be brought into disengagement from the protrusion 17 so that the clutch spring 5 loosens until the diameter thereof is returned to its original diameter to disengage from the inner cylindrical surfaces 14 and 29. When the clutch spring 5 disengages from the inner cylindrical surface 14, it will cause the hammer 3 to advance to its original position together with the steel balls 10 and 11 with the aid of the spring force of the compression coil spring 12 while being rotated by the drive shaft 2. After rotating a half cycle, the end of the clutch spring 5 engages the other protrusion 18 so that the clutch spring 5 is wound around the inner cylindrical surfaces 14 and 29 again to transmit the increased torque of the hammer 3 to the tool bit 40 without any impact or noise for tightening the screw 35. This operation is repeated dependent upon the degree of reaction from the screw 35 to complete the screw-driving operation.

FIG. 3 shows the clutch spring 5 immediately before disengaging from the protrusion 17 when the hammer 3 is moved back (i.e., upward as viewed in the drawing) to a maximum clutch-releasing position. In this condition, an interval between the hammer 3 and the anvil 4 becomes maximum, however, the clutch spring 5 is prevented from entering between the hammer 3 and the anvil 4 to be damaged since the mating surfaces of the hammer 3 and the anvil 4 are both tapered.

In a screw-loosening operation, the drive shaft 2 is reversed by the electric motor 100. Since the end of the clutch spring 5 is secured in the hole 34 of the anvil 4, the clutch spring 5 selectively engages and disengages from the outer cylindrical surfaces 15 and 30 of the hammer 3 and the anvil 4 in a similar manner to the above mentioned screw-tightening operation.

Figure 4:
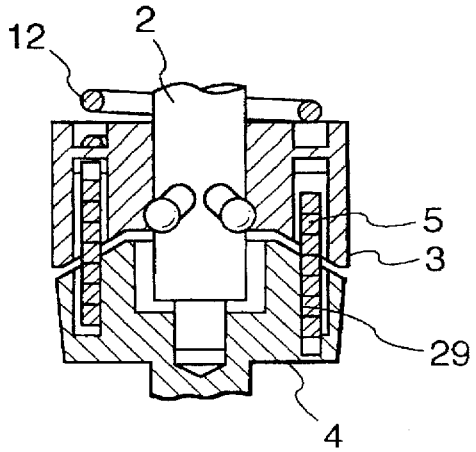
FIG. 4 is a partial cross sectional view which shows a modification of an engaging arrangement of a clutch spring.
Figure 5:
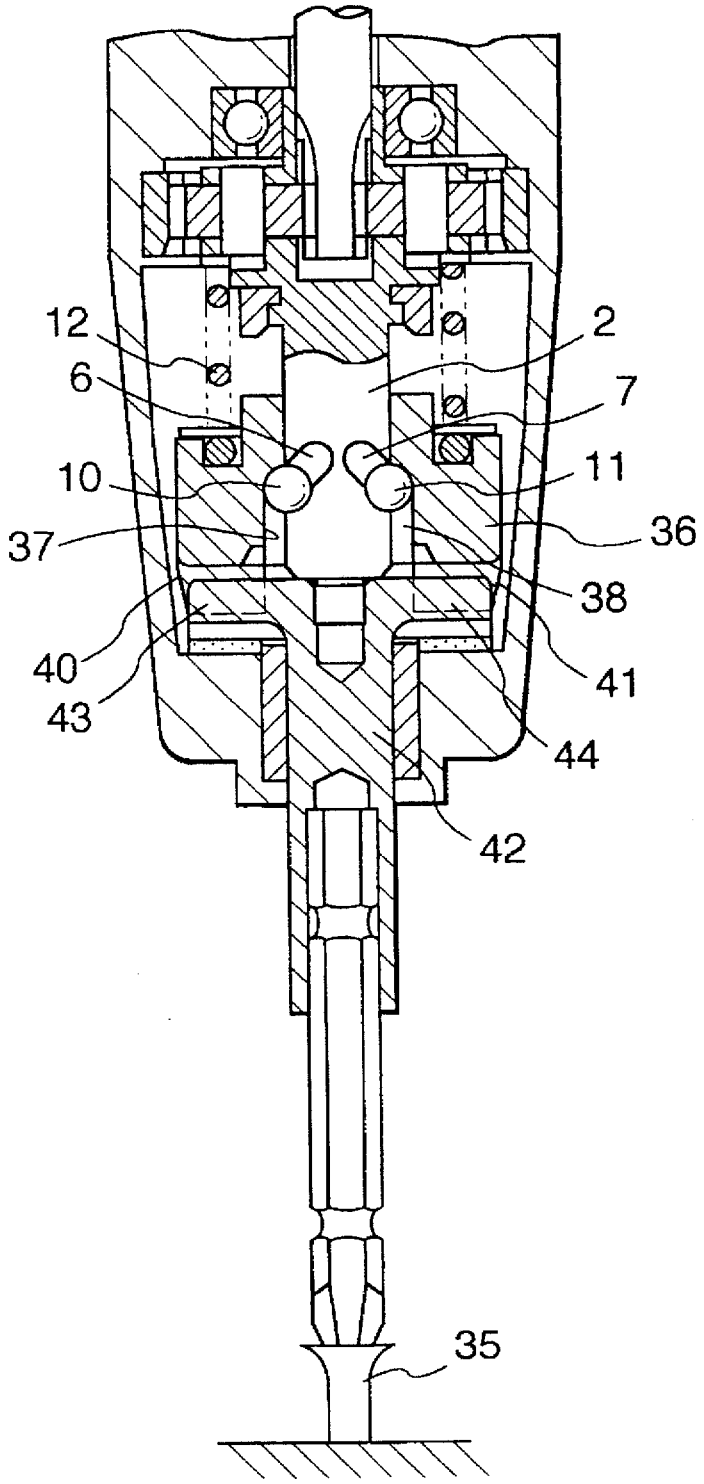
FIG. 5 (PRIOR ART)
FIG. 5 is a vertical cross sectional view which shows a conventional impact screwdriver.

The clutch spring 5, as shown in FIG. 4, may be wound around either the inner cylindrical surface 29 or the outer cylindrical surface 30 of the anvil 4 or alternatively be wound around both the surfaces 29 and 30. Additionally, the clutch spring 5 may be secured at its end to the cylindrical groove 13 of the hammer 3, while the protrusions 17 and 18 are formed in the cylindrical groove 28 of the anvil 4. Further, the clutch spring 5 may be formed with a round spring member.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims. For example, the impact screwdriver of the invention may be used to tighten nuts or drill holes.

What is claimed is:

1. A torque outputting apparatus, comprising:

a torque-outputting member;

a drive shaft rotated by a motor;

a torque-transmitting member transmitting torque provided by rotation of said drive shaft to said torque-outputting member for outputting the torque through said torque-outputting member;

a clutch spring selectively connecting between said torque-outputting member and said torque-transmitting member to establish torque transmission therebetween in first and second relative angular positions of said torque-outputting member and said torque-transmitting member, a first level of torque being transmitted to said torque-outputting member in said first relative angular position and a second level of torque greater than the first level being transmitted to said torque-outputting member in said second relative angular position; and cam means, responsive to the rotation of said drive shaft, for connecting said torque-outputting member and said torque-transmitting member through said clutch spring in said first relative angular position until the torque of said drive shaft reaches a given level for outputting the first level of torque through said torque-outputting member, said cam means releasing the connection between said torque-outputting member and said torque-transmitting member to allow a relative rotation between said torque-outputting member and said torque-transmitting member until said second relative angular position is reached when the torque of said drive shaft exceeds said given level for outputting the second level of torque through said torque-outputting member.

2. The torque-outputting apparatus as set forth in claim 1, wherein:

said clutch spring is a coil spring which is selectively wound over said torque-outputting member and said torque-transmitting member to selectively establish the connection therebetween.

3. The torque-outputting apparatus as set forth in claim 2, wherein:

said torque-outputting member and said torque-transmitting member are formed to have respective cylindrical grooves within which said clutch spring is disposed.

4. The torque-outputting apparatus as set forth in claim 3, wherein:

said torque-outputting member has securing means for securing one end of the coil spring thereto, while said torque-transmitting member has engaging means for having the other end of the coil spring engage therewith in said first and second relative angular positions of said torque-outputting means and said torque-transmitting means.

5. The torque-outputting apparatus as set forth in claim 3, wherein:

said torque-transmitting member has securing means for securing one end of the coil spring thereto, while said torque-outputting member has engaging means for having the other end of the coil spring engage therewith in said first and second relative angular positions of said torque-outputting means and said torque-transmitting means.

6. The torque-outputting apparatus as set forth in claim 1, wherein:

said torque-outputting means and said torque-transmitting means are arranged in alignment with each other at a given interval therebetween.

7. The torque-outputting apparatus as set forth in claim 6, further comprising:

jam prevention means for preventing said clutch spring from entering the given interval between said torque-outputting means and said torque-transmitting means.

8. The torque-outputting apparatus as set forth in claim 7, wherein:

said jam prevention means comprises tapered surfaces of clutch jaws formed on said torque-outputting member and said torque-transmitting member, respectfully.

9. The torque-outputting apparatus as set forth in claim 1, wherein:

said cam means includes a first cam groove, a second cam groove, and a cam follower, the first cam groove being formed on said drive shaft, the second cam groove being formed in said torque-transmitting member, the cam follower being retained between the first and second cam grooves to serve to move said torque-transmitting member for releasing the connection between said torque-outputting member and said torque-transmitting member when the torque of said drive shaft exceeds said given level.

10. The torque-outputting apparatus as set forth in claim 9, wherein:

said cam follower includes a ball member, said first cam groove being of V-shape, the ball member moving said torque-transmitting member away from said torque-outputting member along a given path defined by the first and second cam grooves according to the rotation of said drive shaft when the torque of said drive shaft exceeds said given level.

11. A torque-outputting apparatus comprising:

a torque-outputting member;

a drive shaft rotated by a motor;

a torque-transmitting member transmitting torque provided by rotation of said drive shaft to said torque-outputting member for outputting the torque through said torque-outputting member;

a clutch spring; and cam means, responsive to the rotation of said drive shaft, for selectively winding said clutch spring around said torque-outputting member and said torque-transmitting member to establish torque transmission therebetween at two levels according to two respective rotational differences between said torque-transmitting member and said torque-outputting member.

* * * * *